US010801429B2

(12) United States Patent
Asanuma

(10) Patent No.: US 10,801,429 B2
(45) Date of Patent: Oct. 13, 2020

(54) INTERNAL COMBUSTION ENGINE SYSTEM

(71) Applicant: AISAN KOGYO KABUSHIKI KAISHA, Obu-shi, Aichi-ken (JP)

(72) Inventor: Daisaku Asanuma, Gamagori (JP)

(73) Assignee: AISAN KOGYO KABUSHIKI KAISHA, Obu (JP)

( * ) Notice: Subject to any disclaimer, the term of this patent is extended or adjusted under 35 U.S.C. 154(b) by 0 days.

(21) Appl. No.: 16/595,807

(22) Filed: Oct. 8, 2019

(65) Prior Publication Data

US 2020/0149485 A1 May 14, 2020

(30) Foreign Application Priority Data

Nov. 8, 2018 (JP) ..... 2018-210461

(51) Int. Cl.
*F02M 1/00* (2006.01)
*F02D 41/00* (2006.01)
*F02D 41/14* (2006.01)

(52) U.S. Cl.
CPC ..... *F02D 41/0042* (2013.01); *F02D 41/0032* (2013.01); *F02D 41/0045* (2013.01); *F02D 41/1454* (2013.01)

(58) Field of Classification Search
CPC F02M 25/08; F02M 25/0836; F02D 41/0025; F02D 41/003; F02D 41/0032; F02D 41/004
USPC ..... 123/516, 518, 520
See application file for complete search history.

(56) References Cited

U.S. PATENT DOCUMENTS 6,338,336 B1 * 1/2002 Iida ..... F02D 41/0042 123/520
2004/0261765 A1 * 12/2004 Osanai ..... F02D 41/0045 123/325
2005/0022797 A1 * 2/2005 Ikemoto ..... F02D 41/1458 123/673

FOREIGN PATENT DOCUMENTS

JP 2007-321681 A 12/2007
JP 2008-019830 A 1/2008

* cited by examiner

*Primary Examiner* — John Kwon
(74) *Attorney, Agent, or Firm* — Oliff PLC

(57) ABSTRACT

In an internal combustion engine system, a controller is configured to: perform a purge control during execution of an A/F feedback learning; detect a purge concentration after execution of the A/F feedback learning; calculate an A/F feedback learning correction value adjusted by offsetting an A/F feedback learning value with a contributing value of the purge concentration; disable updating of the A/F feedback learning correction value after calculation of the A/F feedback learning correction value and until the purge control is stopped; and detect the purge concentration based on an air-fuel ratio deviation amount.

2 Claims, 3 Drawing Sheets

INTERNAL COMBUSTION ENGINE SYSTEM

CROSS-REFERENCE TO RELATED APPLICATIONS

This application is based upon and claims the benefit of priority from the prior Japanese Patent Application No. 2018-210461 filed on Nov. 8, 2018, the entire contents of which are incorporated herein by reference.

BACKGROUND

Technical Field

This disclosure relates to an internal combustion engine system including a vaporized fuel treating apparatus configured to perform treatment to supply vaporized fuel generated in a fuel tank to an internal combustion engine through an intake passage.

Related Art

In an internal combustion engine system, an air-fuel ratio learning is executed to compensate an air-fuel ratio deviation amount between an air-fuel ratio detected by an A/F sensor (an air-fuel ratio sensor) or the like provided in an exhaust passage and a target air-fuel ratio.

As one example of the internal combustion engine system for performing such air-fuel ratio learning, Japanese unexamined patent application publication No. 2007-321681 (JP 2007-321681A) discloses an air-fuel ratio control device for an internal combustion engine. This device in JP 2007-321681A is configured to set a learning correction value and a learning guard value (upper and lower limit values) from an air-fuel ratio learning value during execution of purge control by use of a previously detected fuel state of purge gas (e.g., concentration).

SUMMARY

Technical Problems

In the device disclosed in JP 2007-321681A, however, the purge control is stopped, or disabled, when the learning correction value is in a predetermined state (e.g., near a learning guard value). This leads to a decrease in purge flow rate (i.e., a flow rate of purge gas) and causes deterioration of evaporative emission, that is, an increase in exhaust amount of vaporized fuel released to atmosphere.

The present disclosure has been made to address the above problems and has a purpose to provide an internal combustion engine system capable of performing an air-fuel ratio learning while preventing a decrease in purge flow rate and deterioration of evaporative emission.

Means of Solving the Problems

To achieve the above-mentioned purpose, one aspect of the present disclosure provides an internal combustion engine system comprising: an internal combustion engine; a vaporized fuel treating apparatus configured to execute a purge control for treatment to supply purge gas to the internal combustion engine, the purge gas containing vaporized fuel generated in a fuel tank that stores fuel to be supplied to the internal combustion engine; an air-fuel ratio detecting unit configured to detect an air-fuel ratio in the internal combustion engine; and a controller configured to execute an air-fuel ratio learning to compensate an air-fuel deviation amount which is a deviation amount between the air-fuel ratio detected by the air-fuel ratio detecting unit and a target air-fuel ratio, and configured to control an amount of the fuel to be supplied to the internal combustion engine based on a learning value calculated by the air-fuel ratio learning, wherein the controller is further configured to: execute the purge control during execution of the air-fuel ratio learning; detect a purge concentration after execution of the air-fuel ratio learning, the purge concentration being a concentration of the purge gas; calculate a learning correction value by offsetting the learning value with a value corresponding to an extent of contribution of the purge concentration; and disable updating of the learning correction value and detect the purge concentration based on the air-fuel deviation amount after calculation of the learning correction value until the purge control is stopped.

According to the foregoing configuration, the purge control is performed while the air-fuel ratio learning is being in execution. At that time, a value corresponding to the amount of an air-fuel ratio deviated when the purge control is carried out during execution of the air-fuel ratio learning is absorbed into the learning value calculated by the air-fuel ratio learning. After execution of the air-fuel ratio learning, the purge concentration is detected and the learning value is compensated to the learning correction value based on the detected purge concentration. In this manner, the purge control is performed even during execution of the air-fuel ratio learning, so that the air-fuel ratio learning can be conducted while preventing decrease in a purge flow rate and deterioration of evaporative emission. Further, since the amount of fuel to be supplied to the internal combustion engine is controlled based on the learning correction value calculated by compensating the learning value, the air-fuel ratio controllability is enhanced.

After calculation of the learning correction value, updating of the learning correction value is disabled until after the purge control is performed and then stopped. During this period, only updating (detecting) of the purge concentration is performed based on the air-fuel ratio deviation amount. Since updating of the learning correction value is disabled after the learning correction value is calculated as above, it is possible to prevent deterioration of air-fuel ratio controllability due to erroneous learning of the learning correction value. Furthermore, since the purge control is performed after calculation of the learning correction value, it is possible to prevent the purge flow rate from lowering.

The internal combustion engine system of the present disclosure can execute an air-fuel ratio learning while preventing decrease in purge flow rate and deterioration of evaporative emission.

DETAILED DESCRIPTION OF THE EXEMPLARY EMBODIMENTS

A detailed description of an embodiment of an internal combustion engine system which is one of typical embodiments of this disclosure will now be given referring to the accompanying drawings.

<Outline of an Internal Combustion Engine System>

The outline of an internal combustion engine system 1 in the present embodiment will be described below. The internal combustion engine system 1 is mounted in a vehicle such as a car.

Figure 1:
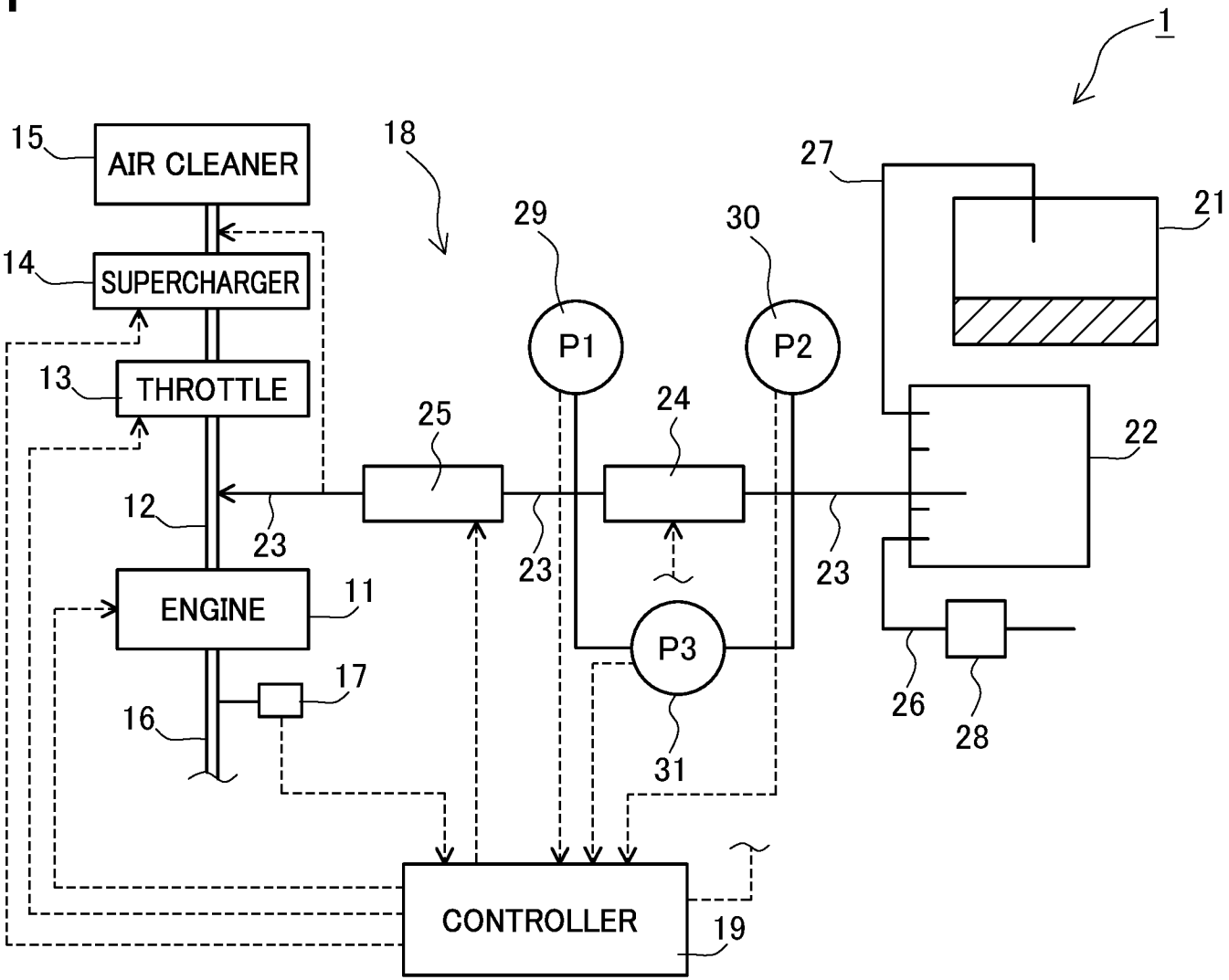
FIG. 1 is a schematic configuration diagram of an internal combustion engine system in an embodiment.

As shown in FIG. 1, in the internal combustion engine system 1, an engine 11 (one example of an internal combustion engine) is connected to an intake passage 12 for supplying air, i.e., intake air. In the intake passage 12, a throttle 13 (i.e., a throttle valve) is provided to open and close the intake passage 12 to control the amount of air ("intake air amount") allowed to flow in the engine 11. In the intake passage 12, on an upstream side of the throttle 13, that is, on an upstream side in a flowing direction of the intake air, there are provided a supercharger 14 and an air cleaner 15. This air cleaner 15 serves to remove foreign substances from the air which will enter the intake passage 12. Accordingly, the air flows through the intake passage 12 via the air cleaner 15 and then is sucked in the engine 11.

The engine 11 is further connected to an exhaust passage 16 allowing exhaust air discharged from the engine 11 to flow. In this exhaust passage 16, an air-fuel ratio sensor 17 (one example of an air-fuel ratio detecting unit) is provided to detect an air-fuel ratio in the engine 11, that is, an air-fuel ratio of the exhaust air discharged from the engine 11.

The internal combustion engine system 1 includes a vaporized fuel treating apparatus 18. This vaporized fuel treating apparatus 18 is configured to perform a purge control for treatment to supply purge gas to the engine 11 through the intake passage 12, the purge gas containing vaporized fuel generated in a fuel tank 21 that stores fuel to be supplied to the engine 11.

As shown in FIG. 1, the vaporized fuel treating apparatus 18 includes a canister 22, a purge passage 23, a purge pump 24, a purge control valve 25, an atmosphere passage 26, a vapor passage 27, a filter 28, a first pressure sensor (P1) 29, a second pressure sensor (P2) 30, a third pressure sensor (P3) 31, and others.

The canister 22 is connected to the fuel tank 21 through the vapor passage 27 and stores vaporized fuel which flows therein from the fuel tank 21 through the vapor passage 27. The canister 22 communicates with each of the purge passage 23 and the atmosphere passage 26.

The purge passage 23 is connected to the intake passage 12 and the canister 22. Thus, the purge gas (i.e., the gas that contains vaporized fuel) flowing out of the canister 22 passes through the purge passage 23 and then flows in the intake passage 12. In the example shown in FIG. 1, the purge passage 23 is connected to the intake passage 12 at a position downstream of the throttle 13, i.e., on a downstream side of a flowing direction of the intake air. However, the connecting position of the purge passage 23 is not limited to the above and for example the purge passage 23 may be connected to the intake passage 12 at a position upstream of the supercharger 14.

The purge pump 24 is provided in the purge passage 23 and configured to adjust a flow rate of purge gas flowing through the purge passage 23. Specifically, the purge pump 24 is operative to deliver the purge gas from the canister 22 into the purge passage 23 and supply the purge gas delivered in the purge passage 23 to the intake passage 12.

The purge control valve 25 is placed at a position downstream of the purge pump 24 in the purge passage 23, i.e., on a downstream side of a flowing direction of the purge gas during execution of the purge control, that is, at a position between the purge pump 24 and the intake passage 12. The purge control valve 25 is configured to open and close the purge passage 23. During closing of the purge control valve 25, i.e., while the purge control valve 25 is in a closed state, the purge gas in the purge passage 23 is blocked off by the purge control valve 25 from flowing toward the intake passage 12. On the other hand, during opening of the purge control valve 25, i.e., while the purge control valve 25 is in an open state, the purge gas is allowed to flow in the intake passage 12.

The atmosphere passage 26 has one end that is open to the atmosphere and the other end connected to the canister 22 to provide communication between the canister 22 and the atmosphere. The atmosphere passage 26 allows air taken from the atmosphere via the filter 28 to flow through.

The vapor passage 27 is connected to the fuel tank 21 and the canister 22. Accordingly, the vaporized fuel in the fuel tank 21 is allowed to flow in the canister 22 through the vapor passage 27.

The internal combustion engine system 1 includes a controller 19, which is a part of an ECU (not shown) mounted in a vehicle. This controller 19 may alternatively be placed separately from the ECU. The controller 19 includes a CPU and memories, such as, a ROM and a RAM. The controller 19 is configured to control the internal combustion engine system 1 according to programs stored in advance in the memories. Furthermore, the controller 19 is also configured to obtain detection results from each sensor; the first pressure sensor 29, the second pressure sensor 30, the third pressure sensor 31, and the air-fuel ratio sensor 17.

The first pressure sensor 29 is configured to detect the pressure in the purge passage 23 at a position downstream of the purge pump 24. The second pressure sensor 30 is configured to detect the pressure in the purge passage 23 at a position upstream of the purge pump 24. The third pressure sensor 31 is configured to detect a differential pressure between the pressures at the positions upstream and downstream of the purge pump 24 in the purge passage 23. It is to be noted that all of the first pressure sensor 29, the second pressure sensor 30, and the third pressure sensor 31 are not necessarily be required to be provided together as long as at least one of the first pressure sensor 29, the second pressure sensor 30, and the third pressure sensor 31 is provided.

In the internal combustion engine system 1 configured as above, when a predetermined purge condition is met during operation of the engine 1, the controller 19 controls the purge pump 24 and the purge control valve 25, concretely, drives the purge pump 24 and opens the purge control valve 25, to perform the purge control. This purge control is a control for treatment that supplies purge gas from the canister 22 to the engine 11 through the purge passage 23 and the intake passage 12.

While the purge control is being executed, the engine 11 is supplied with the air taken in the intake passage 12, the fuel injected, or supplied, from the fuel tank 21 via a fuel injection valve (i.e., a fuel supply unit not shown), and the purge gas supplied to the intake passage 12 by the purge control. The controller 19 controls an injection time of the fuel injection valve, a valve opening time of the purge control valve 25, and others, to adjust the air-fuel ratio (A/F) in the engine 11 to an optimal air-fuel ratio (e.g., an ideal air-fuel ratio ratio).

<Air-Fuel Ratio Control>

The air-fuel ratio control to be performed by the controller 19 will be described below. In the air-fuel ratio control, the controller 19 executes an A/F feedback learning (i.e., an air-fuel ratio learning) to compensate an air-fuel ratio deviation amount which is an amount of deviation between an air-fuel ratio (i.e., a detected air-fuel ratio) detected by the air-fuel ratio sensor 17 and a target air-fuel ratio. The controller 19 calculates an A/F feedback learning value used to compensate the air-fuel ratio deviation amount by carrying out the A/F feedback learning. The controller 19 thus controls the amount of fuel to be injected to the engine 11 (i.e., the amount of fuel to be supplied to the engine 11) through the fuel injection valve based on the calculated A/F feedback learning value.

Herein, when the purge control is performed during execution of the A/F feedback learning, it is indistinctive whether the foregoing air-fuel ratio deviation amount has been generated by execution of the purge control or due to other factors, for example, defects or individual differences of the fuel injection valve or the air-fuel ratio sensor 17, and others. During execution of the A/F feedback learning, therefore, in general, the purge control is stopped in order to prevent erroneous learning. However, when the purge control is stopped, the purge flow rate, i.e., the flow rate of purge gas to be supplied to the engine 11 through the intake passage 12, may decrease, leading to deterioration of evaporative emission, that is, increase in amount of vaporized fuel to the atmosphere.

In the present embodiment, therefore, the controller 19 is configured to perform the purge control even during execution of the A/F feedback learning and execute a control to compensate, or offset, the A/F feedback learning value later with a value corresponding to the air-fuel ratio deviation amount generated when the purge control is executed. To be concrete, the controller 19 executes the control based on a control flowchart shown in FIG. 2.

Figure 2:
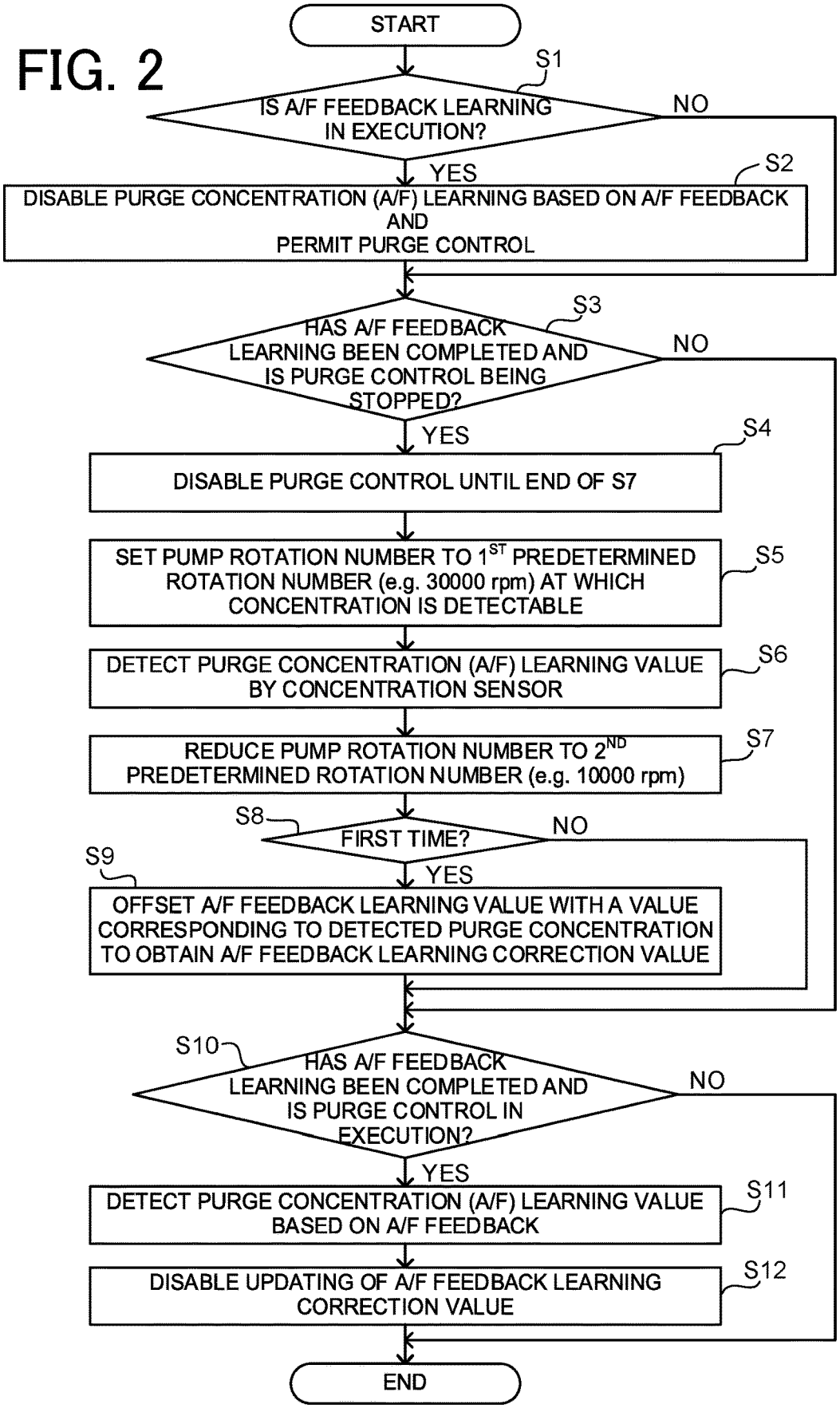
FIG. 2 is a control flowchart showing control contents to be performed in the embodiment.

As shown in FIG. 2, when the A/F feedback learning is in execution (step S1: YES), the controller 19 disables the purge concentration (A/F) learning by the A/F feedback, i.e., disables detection of the purge concentration based on the air-fuel ratio deviation amount, whereas the controller 19 permits execution of the purge control and executes and then stops the purge control (step S2).

In the present embodiment, as described above, when the predetermined purge condition is established, the controller 19 carries out the purge control even during execution of the A/F feedback learning. At that time, the A/F feedback learning value calculated by the A/F feedback learning is adjusted to absorb a value corresponding to the air-fuel ratio deviation amount generated by execution of the purge control.

Subsequently, the controller 19 determines if the A/F feedback learning has been completed and the purge control is being stopped (step S3). If a positive answer is obtained (S3: YES), the controller 19 then disables the purge control until the process in step S7 mentioned later is terminated (step S4). The controller 19 stops the purge control after executing the A/F feedback learning in the above manner.

The controller 19 then sets the pump rotation number (i.e., the number of rotations of the purge pump 24) to a first predetermined rotation number (e.g., 30000 rpm) at which the purge concentration is detectable (step S5). Specifically, during stop of the purge control, the controller 19 sets the pump rotation number to the first predetermined rotation number (a predetermined value) suitable for detection of the purge concentration.

The controller 19 subsequently detects a purge concentration (A/F) learning value (i.e., a purge concentration) with a concentration sensor (step S6). Herein, the concentration sensor is configured to detect the purge concentration for example based on a detection value of the pressure in the purge passage 23. In the present embodiment, the concentration sensor corresponds to the first pressure sensor 29, the second pressure sensor 30, and the third pressure sensor 31. Specifically, the controller 19 detects the purge concentration for example (i) based on only a detection value of the first pressure sensor 29, (ii) based on a difference between a detection value of the first pressure sensor 29 and a detection value of the second pressure sensor 30, or (iii) based on a detection value of the third pressure sensor 31, i.e., a differential pressure between front and back of the purge pump 24.

Then, when the purge concentration is detected, or determined, the controller 19 reduces the pump rotation number to the second predetermined rotation number, e.g., 10000 rpm (step S7). At that time, the controller 19 starts the purge control. Further, a stop period of the purge control in steps S4 to S7 is for example 3 to 6 seconds.

After execution of the A/F feedback learning, the controller 19 detects the purge concentration which is the concentration of purge gas.

The controller 19 then determines whether or not the A/F feedback learning is a first A/F feedback learning since turn-on of an ignition switch (step S8). If an answer is positive (S8: YES), the controller 19 offsets the A/F feedback learning value with a value corresponding to the detected purge concentration to obtain an A/F feedback learning correction value (step S9). In this way, the controller 19 calculates the A/F feedback learning correction value (i.e., a learning correction value, or a compensated A/F feedback learning value) by offsetting the A/F feedback learning value with a value corresponding to an extent of contribution (a "contributing value") of the purge concentration. Specifically, the A/F feedback learning correction value is calculated in such a way that the A/F feedback learning value is corrected with a value corresponding to the air-fuel ratio deviation amount generated by execution of the purge control.

Subsequently, the controller 19 determines whether or not the A/F feedback learning has been completed and also the purge control is in execution (step S10).

Herein, after calculation of the A/F feedback learning correction value, if the A/F feedback learning correction value is updated during execution of the purge control, the A/F feedback learning correction value may be erroneously learnt when the purge concentration changes. In such a case, the amount of fuel to be injected into the engine 11 by the fuel injection valve may be controlled based on the erroneously learnt A/F feedback learning correction value, resulting in deterioration of A/F (air-fuel ratio) controllability. When the purge control is stopped to detect the purge concentration in order to prevent deterioration of the A/F controllability, the purge flow rate is likely to decrease, or loss.

In the present embodiment, therefore, for the purpose of preventing deterioration of the A/F controllability and preventing decrease in purge flow rate mentioned above, after calculation of the A/F feedback learning correction value, updating of the A/F feedback learning correction value is disabled to limit the timing of updating the A/F feedback learning correction value, and only updating of the purge concentration based on the air-fuel ratio deviation amount is performed.

To be concrete, returning to the description of FIG. 2, if the A/F feedback learning has been completed, that is, the A/F feedback learning correction value has been calculated, and also the purge control is being executed (step S10: YES), the controller 19 detects the purge concentration learning value by the A/F feedback (step S11) and disables updating of the A/F feedback learning correction value (step S12).

As above, after calculation of the A/F feedback learning correction value, until after the purge control is executed and then stopped, the controller 19 disables updating of the A/F feedback learning correction value and detects the purge concentration based on the air-fuel ratio deviation amount.

Figure 3:
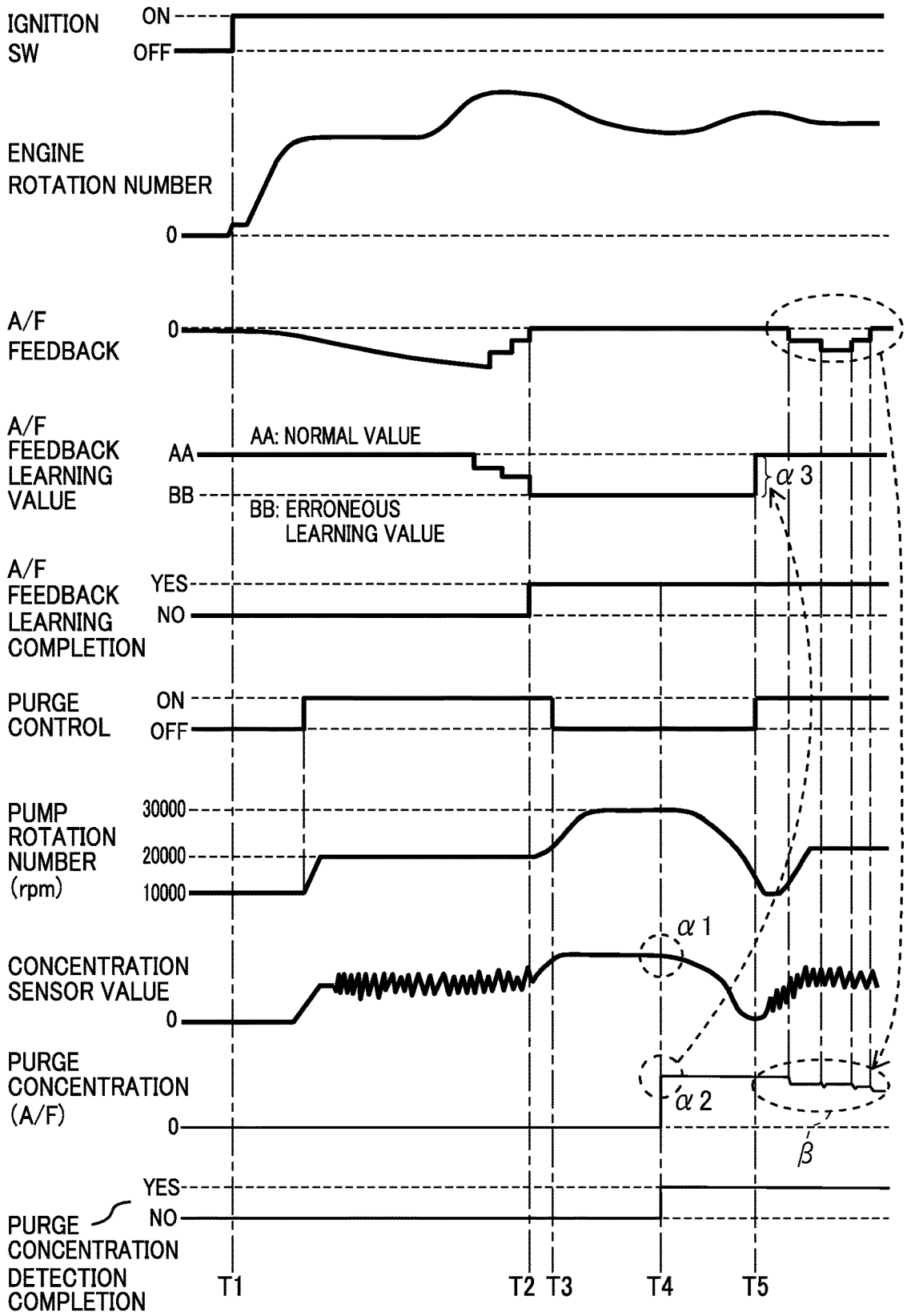
FIG. 3 is a control time chart showing the control contents to be performed in the embodiment.

When the foregoing control is performed based on the control chart shown in FIG. 2, one example of the control time chart shown in FIG. 3 is carried out.

As shown in FIG. 3, when the ignition switch is turned on at time T1 and then the A/F feedback learning is carried out, the air-fuel ratio becomes rich when the purge control is performed and thus the A/F feedback (i.e., the air-fuel ratio deviation amount) is given. When the A/F feedback learning is completed at time T2, the A/F feedback learning value becomes a value erroneously learnt under the influence of the purge concentration, that is, an error learning value. In the present embodiment, as described above, the A/F feedback learning value is adjusted temporarily to absorb a value corresponding to the air-fuel ratio deviation amount generated when the purge control is performed during execution of the A/F feedback learning.

At time T3, successively, the execution of the purge control is stopped or disabled. Then, the pump rotation number is adjusted to the first predetermined rotation number (e.g., 30000 rpm) and, at time T4, the purge concentration (indicated by $\alpha$2 in FIG. 3) is obtained from a detection value of the concentration sensor, herein referred to as a "concentration sensor value", which is indicated by $\alpha$1 in FIG. 3. At time T5, the A/F feedback learning value is compensated so as to be offset with a value (indicated by a3 in FIG. 3) corresponding to the purge concentration obtained at time T4, and thus an A/F feedback learning correction value is calculated. Accordingly, the A/F feedback learning value returns to a normal value.

Subsequently, until after the purge control is executed (from time T5 and subsequent) and then stopped, the purge concentration learning is performed based on the A/F feedback (indicated by $\beta$ in FIG. 3), whereas updating of the A/F feedback learning correction value (i.e., a compensated A/F feedback learning value) is disabled.

<Operations and Effects of the Present Embodiment>

In the foregoing embodiment, the controller 19 performs the purge control during execution of the A/F feedback learning. After completion of execution of the A/F feedback learning, the controller 19 detects the purge concentration and calculates the A/F feedback learning correction value by offsetting the A/F feedback learning value with a contributing value of the purge concentration.

In the present embodiment, as described above, the purge control is carried out even while the A/F feedback learning is being executed. At that time, the A/F feedback learning value calculated by the A/F feedback learning is adjusted to absorb a value corresponding to the air-fuel ratio deviation amount generated by execution of the purge control. After execution of the A/F feedback learning, the purge concentration is detected and further the A/F feedback learning value is compensated to an accurate A/F feedback learning value (i.e., an A/F feedback learning correction value, or a normal value) based on the detected purge concentration. Since the purge control is performed without being stopped even during execution of the A/F feedback learning as described above, the A/F feedback learning can be performed while preventing decrease in purge flow rate and deterioration of evaporative emission. The amount of fuel to be injected to the engine 1 through the fuel injection valve is controlled based on the A/F feedback learning correction value calculated by compensating the A/F feedback learning value, so that the A/F controllability, i.e., the controllability of air-fuel ratio, is enhanced.

Moreover, the A/F feedback learning correction value is calculated based on the A/F feedback learning value calculated during execution of the purge control. Thus, the A/F feedback learning correction value is less likely to deviate from a predetermined range and thus the erroneous learning of the A/F feedback learning correction value is reduced. Since the fuel injection amount to the engine 11 through the fuel injection valve is controlled based on the A/F feedback learning correction value with which erroneous learning can be prevented, the A/F controllability is enhanced and deterioration of exhaust emission is prevented.

After calculation of the A/F feedback learning correction value, until the purge control is stopped, the controller 19 disables updating of the A/F feedback learning correction value and detects the purge concentration based on the air-fuel ratio deviation amount.

Specifically, after the A/F feedback learning correction value is calculated, until after the purge control is executed and stopped, the controller 19 disables updating of the A/F feedback learning correction value and only updates (detects) the purge concentration based on the A/F feedback (i.e., the air-fuel ratio deviation amount). Since updating of the A/F feedback learning correction value is disabled after calculation of the A/F feedback learning correction value, it is possible to prevent deterioration of the A/F controllability due to erroneous learning of the A/F feedback learning correction value. Further, since the purge control is performed after the A/F feedback learning correction value is calculated, it is possible to prevent the purge flow rate from decreasing.

For the purge concentration to be detected for calculation of the A/F feedback learning correction value after execution of the A/F feedback learning, the controller 19 performs this detection based on a detection value of pressure in the purge passage 23. At that time, the controller 19 detects the purge concentration after setting the pump rotation number to the first rotation number (e.g., 30000 rpm) during stop of the purge control. For this detection of the purge concentration, the controller 19 uses for example any one of a detection value of the first pressure sensor 29 alone, a difference between a detection value of the first pressure sensor 29 and a detection value of the second pressure sensor 30, and a detection value of the third pressure sensor 31 (i.e., a differential pressure between front and back of the purge pump 24).

Since detecting of the purge concentration is performed during stop of the purge control while the pump rotation number is set to the first predetermined rotation number suitable for detection of the purge concentration, the accuracy of detecting the purge concentration can be enhanced.

In the present embodiment, furthermore, the controller 19 detects the purge concentration through the concentration sensor (e.g., the first pressure sensor 29, the second pressure sensor 30, and the third pressure sensor 31) during stop of the purge control or through the A/F feedback (i.e., the air-fuel ratio deviation amount) during execution of the purge control.

The foregoing embodiments are mere examples and give no limitation to the present disclosure. The present disclosure may be embodied in other specific forms without departing from the essential characteristics thereof. For instance, the air-fuel ratio detecting unit for detecting an air-fuel ratio of the engine 11 may be any unit or device other than the air-fuel ratio sensor 17 provided in the exhaust passage 16. Further, the concentration sensor for detecting a purge concentration may be any unit or device other than the pressure sensor.

REFERENCE SIGNS LIST

1 Internal combustion engine system
11 Engine
12 Intake passage
13 Throttle
14 Supercharger
15 Air cleaner
16 Exhaust passage
17 Air-fuel ratio sensor
18 Vaporized fuel treating apparatus
19 Controller
21 Fuel tank
22 Canister
23 Purge passage
24 Purge pump
25 Purge control valve
26 Atmosphere passage
27 Vapor passage
28 Filter
29 First pressure sensor
30 Second pressure sensor
31 Third pressure sensor

What is claimed is:

1. An internal combustion engine system comprising:

an internal combustion engine;

a vaporized fuel treating apparatus configured to execute a purge control for treatment to supply purge gas to the internal combustion engine, the purge gas containing vaporized fuel generated in a fuel tank that stores fuel to be supplied to the internal combustion engine;

an air-fuel ratio detecting unit configured to detect an air-fuel ratio in the internal combustion engine; and a controller configured to execute an air-fuel ratio learning to compensate an air-fuel deviation amount which is a deviation amount between the air-fuel ratio detected by the air-fuel ratio detecting unit and a target air-fuel ratio, and configured to control an amount of the fuel to be supplied to the internal combustion engine based on a learning value calculated by the air-fuel ratio learning, wherein the controller is further configured to:

execute the purge control during execution of the air-fuel ratio learning;

detect a purge concentration after execution of the air-fuel ratio learning, the purge concentration being a concentration of the purge gas;

calculate a learning correction value by offsetting the learning value with a value corresponding to an extent of contribution of the purge concentration; and disable updating of the learning correction value and detect the purge concentration based on the air-fuel deviation amount after calculation of the learning correction value until the purge control is stopped.

2. The internal combustion engine system according to claim 1, wherein the vaporized fuel treating apparatus includes a purge passage for flowing the purge gas and a purge pump provided in the purge passage, the purge pump being configured to control a flow rate of the purge gas, and the controller is configured to detect the purge concentration for calculation of the learning correction value after execution of the air-fuel ratio learning, based on a detection value of pressure in the purge passage while a number of rotations of the purge pump is set to a predetermined value during stop of the purge control.

* * * * *